US011434704B2

(12) United States Patent
Tuttle et al.

(10) Patent No.: US 11,434,704 B2
(45) Date of Patent: Sep. 6, 2022

(54) ALTERNATE PATH FOR BOREHOLE JUNCTION

(71) Applicants: Elliott Tuttle, Anchorage, AK (US); David Wages, Anchorage, AK (US)

(72) Inventors: Elliott Tuttle, Anchorage, AK (US); David Wages, Anchorage, AK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/126,391

(22) Filed: Dec. 18, 2020

(65) Prior Publication Data

US 2022/0195817 A1 Jun. 23, 2022

(51) Int. Cl.

| | |
|---|---|
| ***E21B 17/18*** | (2006.01) |
| ***E21B 33/12*** | (2006.01) |
| ***E21B 43/12*** | (2006.01) |
| ***E21B 7/04*** | (2006.01) |
| *E21B 43/08* | (2006.01) |

(52) U.S. Cl.

CPC ..... *E21B 17/18* (2013.01); *E21B 7/046* (2013.01); *E21B 33/12* (2013.01); *E21B 43/12* (2013.01); *E21B 43/08* (2013.01)

(58) Field of Classification Search

CPC ..... E21B 17/18; E21B 7/046; E21B 33/12; E21B 43/12; E21B 43/08; E21B 7/06

USPC ..... 166/305.1

See application file for complete search history.

(56) References Cited

U.S. PATENT DOCUMENTS

| | | | | |
|---|---|---|---|---|
| 3,841,420 A * | 10/1974 | Russell | E21B 7/068 175/45 |
| 5,115,872 A * | 5/1992 | Brunet | E21B 7/061 166/117.5 |
| 6,354,375 B1 | 3/2002 | Dewey | |
| 7,207,390 B1 * | 4/2007 | Pratt | E21B 7/061 166/117.6 |

(Continued)

FOREIGN PATENT DOCUMENTS

| | | |
|---|---|---|
| AU | 744289 B2 | 2/1998 |
| JP | 2010538187 A | 12/2010 |
| WO | 199809053 A2 | 3/1998 |

OTHER PUBLICATIONS

Notification of Transmittal and International Search Report and Written Opinion; PCT/US2021/062393; dated Mar. 25, 2022; 11 pages.

*Primary Examiner* — Matthew R Buck
*Assistant Examiner* — Patrick F Lambe
(74) *Attorney, Agent, or Firm* — Cantor Colburn LLP

(57) ABSTRACT

A method for flowing a fluid from and/or to a subsurface formation includes disposing a main production tubular in a main borehole penetrating the subsurface formation, the main production tubular being coupled to a shunt assembly, the shunt assembly defining an opening oriented and biased in a desired direction for a lateral borehole penetrating the subsurface formation and having a shunt tube that bypasses the opening. The method also includes drilling the lateral borehole through the opening in the shunt assembly and installing a completion having a lateral production tubular coupled to a completion device in the lateral borehole through the opening. The method further incudes flowing the fluid from the subsurface formation to the shunt tube and/or from the shunt tube to the subsurface formation.

20 Claims, 4 Drawing Sheets

(56) References Cited

U.S. PATENT DOCUMENTS

| | | | | |
|---|---|---|---|---|
| 9,291,003 | B2 * | 3/2016 | Sponchia | E21B 7/061 |
| 2004/0055750 | A1 | 3/2004 | Restarick et al. | |
| 2004/0055751 | A1 | 3/2004 | McGlothen et al. | |
| 2004/0149444 | A1 | 8/2004 | Cavender et al. | |
| 2005/0077048 | A1 * | 4/2005 | Hall | E21B 23/006 166/342 |
| 2015/0345264 | A1 * | 12/2015 | Johnson | E21B 43/128 166/311 |
| 2018/0328148 | A1 * | 11/2018 | Glaser | E21B 17/023 |

* cited by examiner

ALTERNATE PATH FOR BOREHOLE JUNCTION

BACKGROUND

Reservoirs of hydrocarbons may be found in unconsolidated shallow sands in subsurface formations. These sands, however, may have multiple sand lobes separated by shales that isolate fluid communication in large fault blocks. Hence, each sand lobe requires a separate borehole penetrating that sand lobe in order to extract the hydrocarbons from it. In formations having stacked sand lobes, completions in lateral boreholes extending from a main borehole may be used to efficiently access the sand lobes. Lateral boreholes may also be required in other types of formations, unconsolidated or not, and multilayered or single layered.

Subsurface formations may also be used for carbon dioxide sequestration. Completions in laterals may be used to access different regions of the formations.

Hence for at least the above reasons, improvements in drilling lateral boreholes from a main borehole and installing completions while not interfering with fluid flows in the main borehole would be well received in the hydrocarbon recovery and carbon dioxide sequestration industries.

BRIEF SUMMARY

Disclosed is a method for flowing a fluid from and/or to a subsurface formation. The method includes: disposing a main production tubular in a main borehole penetrating the subsurface formation, the main production tubular being coupled to a shunt assembly, the shunt assembly defining an opening oriented and biased in a desired direction for a lateral borehole penetrating the subsurface formation and having a shunt tube that bypasses the opening; drilling the lateral borehole through the opening in the shunt assembly; installing a completion having a lateral production tubular coupled to a completion device in the lateral borehole through the opening; and flowing the fluid from the subsurface formation to the shunt tube and/or from the shunt tube to the subsurface formation.

Also disclosed is an apparatus for flowing a fluid from and/or to a subsurface formation. The apparatus includes: a main production tubular disposed in a borehole penetrating the subsurface formation; a shunt assembly coupled to the main production tubular, the shunt assembly defining an opening oriented and biased in a desired direction for a lateral borehole penetrating the subsurface formation and having a shunt tube that bypasses the opening and conveys the fluid from and/or to the subsurface formation; a lateral production tubular disposed in the lateral borehole and coupled to the main production tubular through the shunt assembly; and a completion device coupled to the lateral production tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are embodiments of methods and apparatuses for drilling a lateral borehole from a main borehole. The methods and apparatuses involve installing shunt assemblies in series with production tubing at locations where a lateral borehole is desired. The shunt assemblies are azimuthally directional such that they are required to be installed with their azimuthal direction being lined up with the azimuthal direction desired for the corresponding lateral borehole. With the shunt assemblies in place, a lateral borehole can be drilled and a completion, such as for sand control or injectors, can be installed generally starting with the deepest shunt assembly first. A plugging-style whipstock is installed in the shunt assembly used to drill the lateral borehole in order to prevent sand from entering and dropping down the main borehole. A bypass or shunt tube or tubes provide a path for fluids such as hydrocarbons being extracted further below to bypass each shunt assembly that is plugged thereby allowing the hydrocarbons to be extracted at the surface. Alternatively, the shunt tube or tubes allows a fluid being injected at the surface to bypass plugged shunt assemblies so that the fluid can be injected in laterals having installed completions or further below in the main borehole. For example, the fluid may be injected to stimulate the formation to improve hydrocarbon production or to sequester carbon dioxide in the formation.

Figure 1:
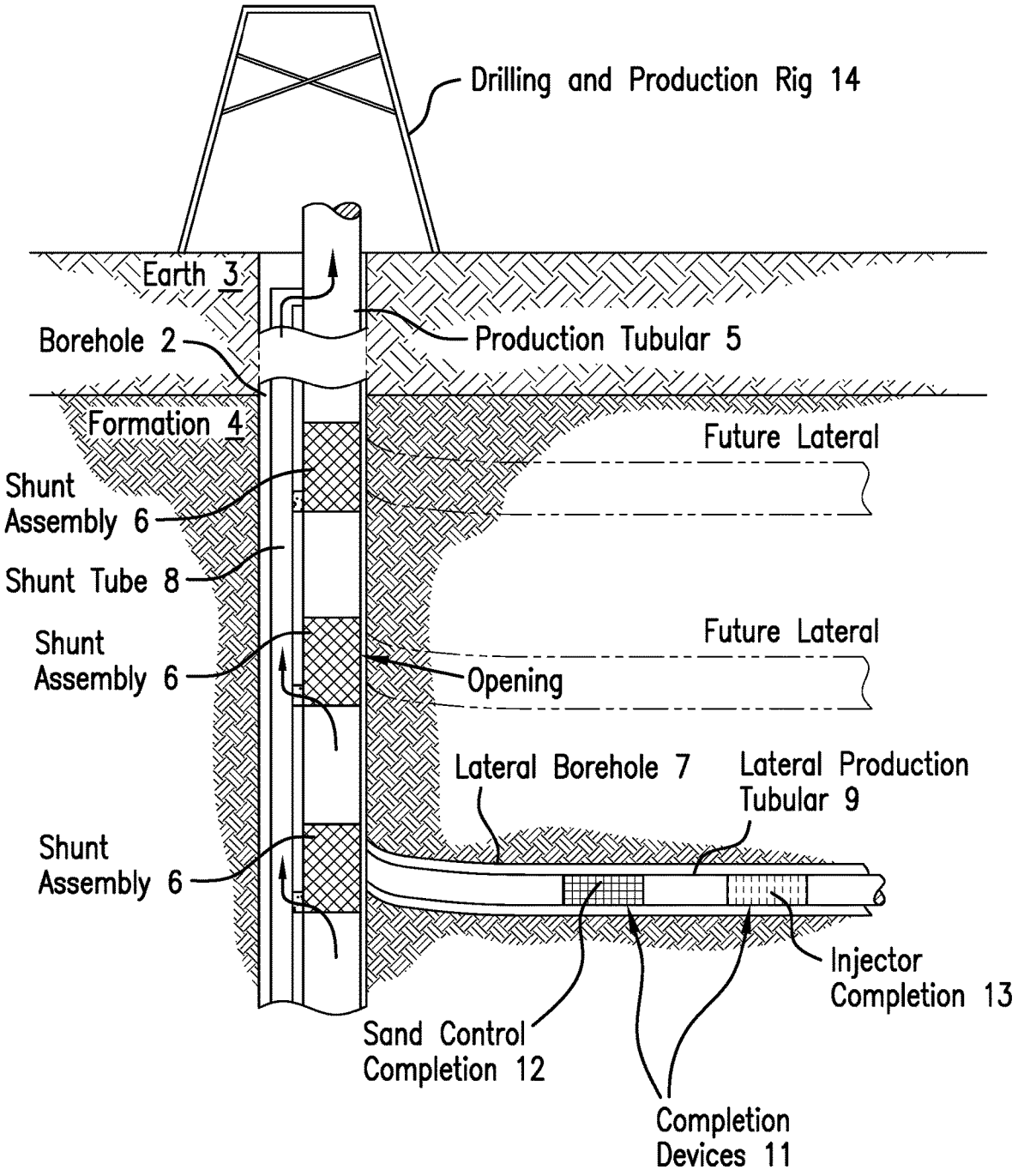
FIG. 1 illustrates a cross-sectional view of an embodiment of a main production tubular disposed in a borehole penetrating the earth where a shunt assembly connects a lateral borehole to the main production tubular.

FIG. 1 illustrates a cross-sectional view of a main production tubular 5 disposed in a main borehole 2 penetrating the earth 3, which has a formation 4 containing a reservoir of hydrocarbons. A plurality of shunt assemblies 6 are disposed in series with sections of the main production tubular 5 where each shunt assembly 6 has an azimuthal orientation or direction in which a lateral borehole 7 is drilled or to be drilled. Each shunt assembly 6 defines an opening through which the lateral borehole 7 is drilled or to be drilled. While FIG. 1 illustrates all of the shunt assemblies 6 having an azimuthal orientation to the right in the plane of the figure, each shunt assembly 6 can have other azimuthal orientations such as having a vector component into or out of the plane of the figure. A lateral production tubular 9 is disposed in the lateral borehole 7. The lateral production tubular 9 is coupled to one or more completion devices 11. Non-limiting embodiments of the completion device 11 include a sand control completion 12, which may include a sand screen, for filtering sand from hydrocarbons entering the tubular 9 and an injector completion 13 for injecting a fluid into the formation 4. A shunt tube 8 bypasses each shunt assembly 6 to allow flow around each shunt assembly 6. The shunt tube 8 may be a continuous substantially vertical flow path as illustrated with an openings below each shunt assembly 6 or the shunt tube 8 may be in sections that use portions of the main production tubular 5 as a flow path between adjacent shunt assemblies 6. Non-linear arrows depict fluid flow path. These embodiments are discussed further below in more detail.

A drilling and production rig 14 is disposed at the surface of the earth 3. The drilling and production rig 14 is configured to perform drilling and production operations such as drilling a borehole with a desired trajectory, installing production tubulars, installing completions and completion devices downhole, and extracting hydrocarbons. As such, the drilling and production rig 14 may include a hoist, electric motors, hydraulic motors, controllers, sensors, instruments, electrical system, piping, fittings, pumps, and/or valves necessary to perform the above operations. In one or more embodiments, the drilling and production rig is configured to drill the borehole using coiled tubing drilling apparatus.

Figure 2:
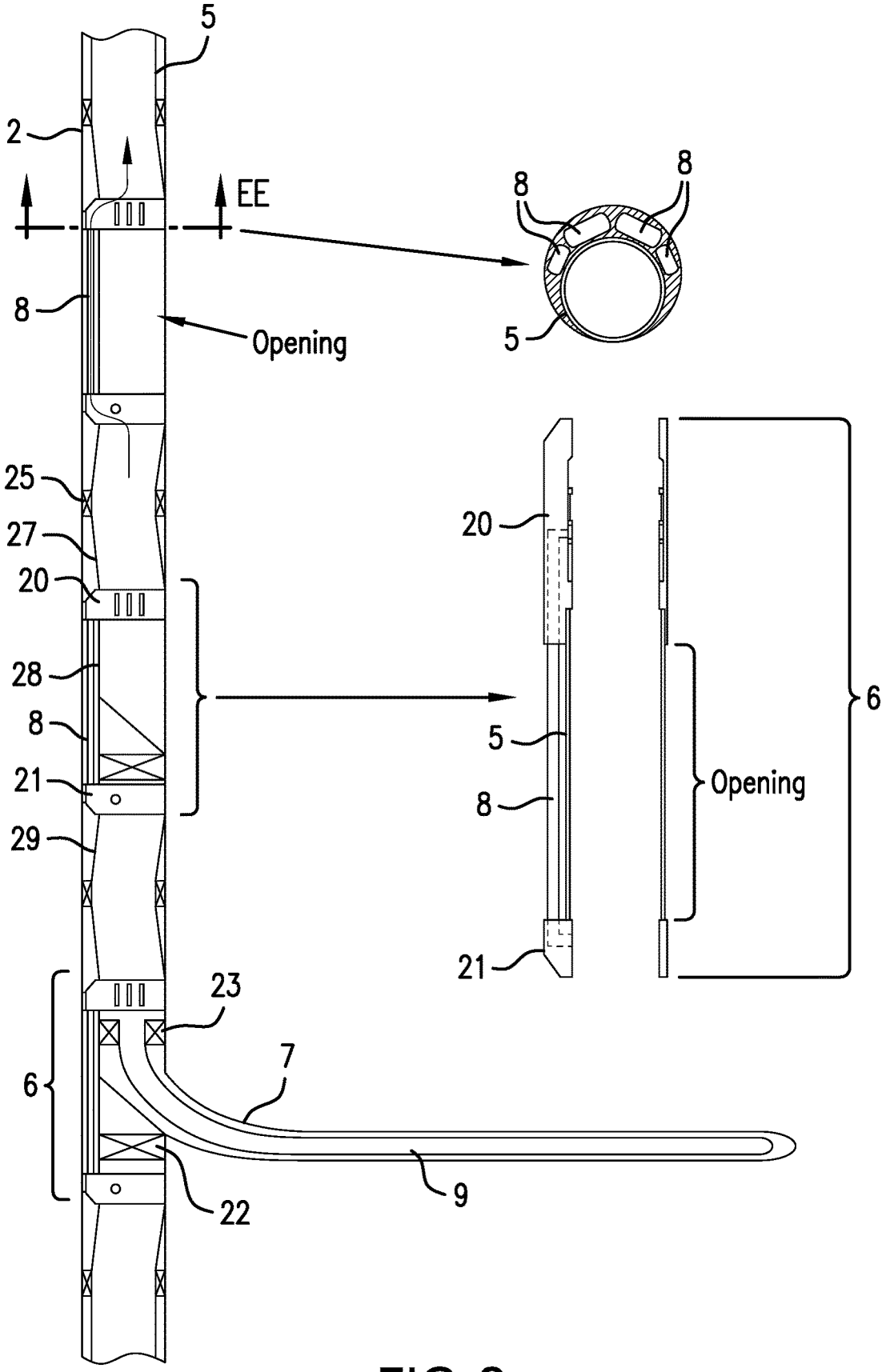
FIG. 2 depicts aspects of shunt assemblies in a first embodiment having discontinuous shunt tubes.

FIG. 2 depicts aspects of a first embodiment in which the shunt tube 8 is in sections and that the main production tubular 5 provides a flow path between the sections of the shunt tube 8. In the embodiment of FIG. 2, an upper eccentric end section 20 is connected to an upper section 27 and to a middle section 28 of the main production tubular 5. In one or more embodiments, the upper eccentric end section 20 is an eccentric sliding sleeve, which can provide for shutting off flow. The sliding sleeve is a device that can act as a valve to open or close fluid flow between the interior of the device and the exterior of the device. In one or more embodiments, the sliding sleeve includes a ported inner sleeve and a movable external shroud. Flow control can then be accomplished by opening or closing the ports with the shroud. The sliding sleeve may be activated by annular pressure, a slick line method, or a coiled tubing method. In that various sliding sleeves are known in the art, they are not discussed herein in further detail.

A lower eccentric end section 21 is connected to the middle section 28 and a lower section 29 of the main production tubular 5. In one or more embodiments, the lower eccentric end section 21 is an eccentric mandrel. The term "eccentric" relates to the middle section 28 being offset from the center of the borehole 2 towards a borehole wall that is to be drilled. Packers 25 are used to centralize sections of the main production tubular 5 that are not within any of the shunt assemblies 6 as well as isolate each shunt assembly from each other. The shunt tube 8 provides a flow path between the lower section 29 and the upper section 27 bypassing the middle section 28. The shunt tube 8 in FIG. 2 includes four shunt tubes 8 as illustrated in the "EE" view. The four shunt tubes 8 are used to make increased use of the cross-sectional area offset from the main production tubular 5. The upper eccentric end section 20 is configured to direct fluid flow from the shunt tubes 8 into the upper section 27 of the main production tubular 5 via a flow path between the tubes 8 and the tubular 5. The lower eccentric end section 21 is configured to direct fluid flow from the lower section 29 into the shunt tubes 8 via a flow path between the tubular 5 and the tubes 8 as illustrated in the expanded view on the right side of FIG. 2. A non-linear arrow indicates a flow path through the upper shunt assembly 6.

The deepest shunt assembly 6 illustrated in FIG. 2 shows the lateral borehole 7 already drilled with the lateral production tubular 9 disposed therein. Although not shown, various types of completions and completion devices 11 may be coupled to the lateral production tubular 9. A plugging-style whipstock 22 is disposed in the deepest shunt assembly 6 in order to prevent debris such as sand from the lateral borehole 7 from entering the main production tubular 5 beneath that shunt assembly 6. A liner top packer 23 is disposed around the lateral production tubular 9 within the shunt assembly 6 to direct fluid flow from the lateral production tubular 9 into the main production tubular 5. The plugging-style whipstock 22 is also installed inside the second deepest shunt assembly 6, as illustrated in FIG. 2, in anticipation of the lateral borehole 7 to be drilled there.

Figure 3:
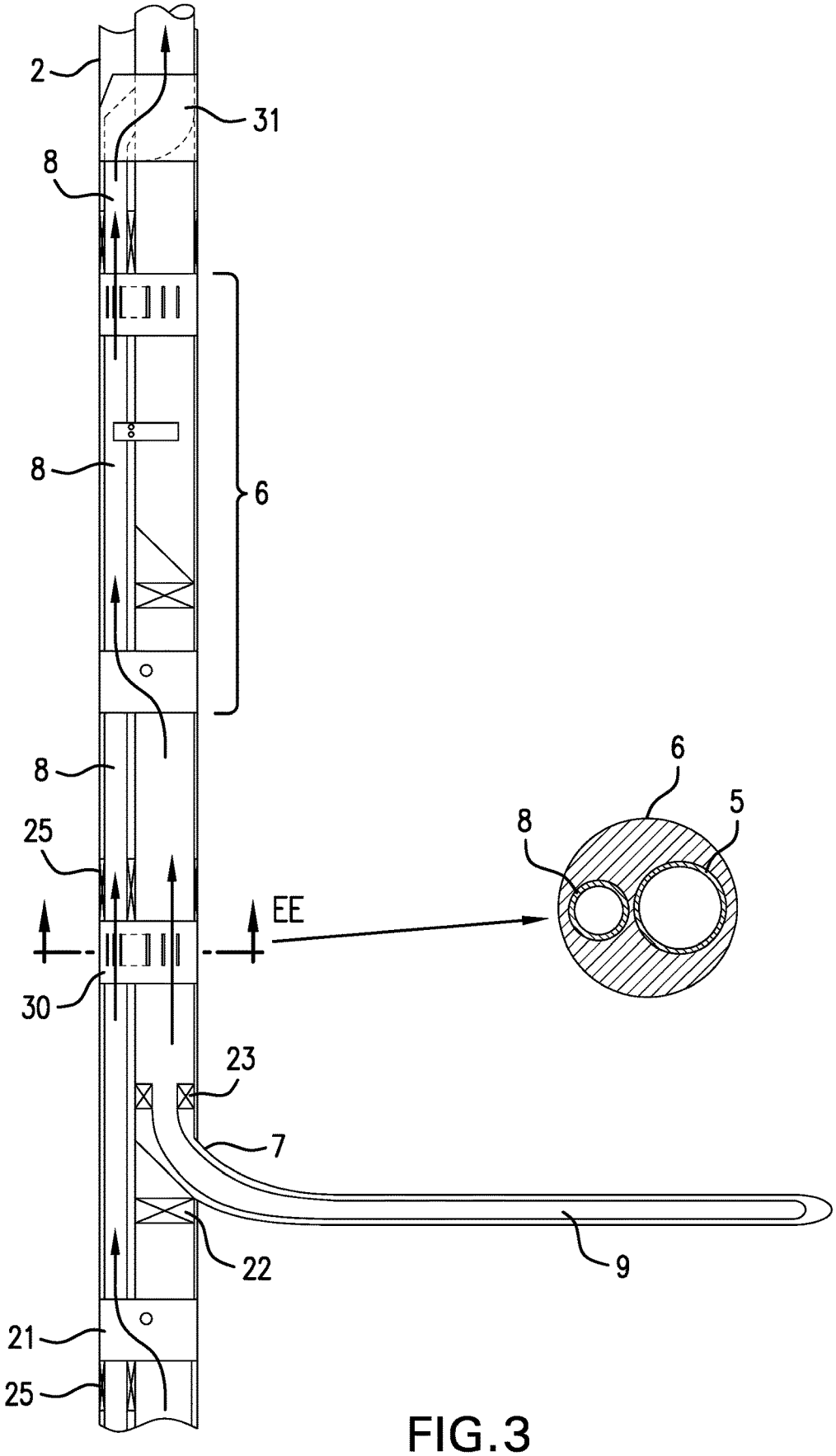
FIG. 3 depicts aspects of the shunt assemblies in a second embodiment having a continuous shut tube.

FIG. 3 depicts aspects of a first embodiment in which the shunt tube 8 is a continuous tube or flow path leading from the deepest shunt assembly 6 to a diverter 31 above that shunt assembly 6. Section "EE" of FIG. 3 illustrates a top view of an upper pass-through section 30 illustrating the main production tubular 5 and the continuous shunt tube 8 passing through the upper pass-through section 30. The packers 25 may be used to keep the tubular 5 and shunt tube 8 in a desired alignment. The packers 25 may also be used to separate or mechanically isolate each shunt exit point (i.e., each desired place to drill a lateral bore) from adjacent shunt exit points to allow all sand controlled fluid or controlled injected fluid to flow where needed and not disturb any next shunt exit point. It can be appreciated that packers may not be needed to provide the mechanical isolation. In formations where the differential pressure across each lateral borehole is low, the shunt assembly, which can be continuous as in FIG. 2 or non-continuous as in FIG. 3, can be cemented in place to provide the mechanical isolation. In one or more embodiments, the diverter 31 is above the shallowest shunt assembly 6 as depicted in FIG. 3. The diverter 31 is configured to direct flow from the shunt tube 8 into the main production tubular 5. In one or more embodiments, the diverter 31 may include a sliding sleeve. Hence, drilling a lateral borehole with a closed sliding sleeve in the diverter allows control of pressure in the main production tubular. In one or more embodiments, sliding sleeves may be disposed in both bores (i.e., the tubular 5 and the shunt tube 8) for shutting off flow. Open sleeves only communicate with each other. This allows laterals to be shut off when in production.

Figure 4:
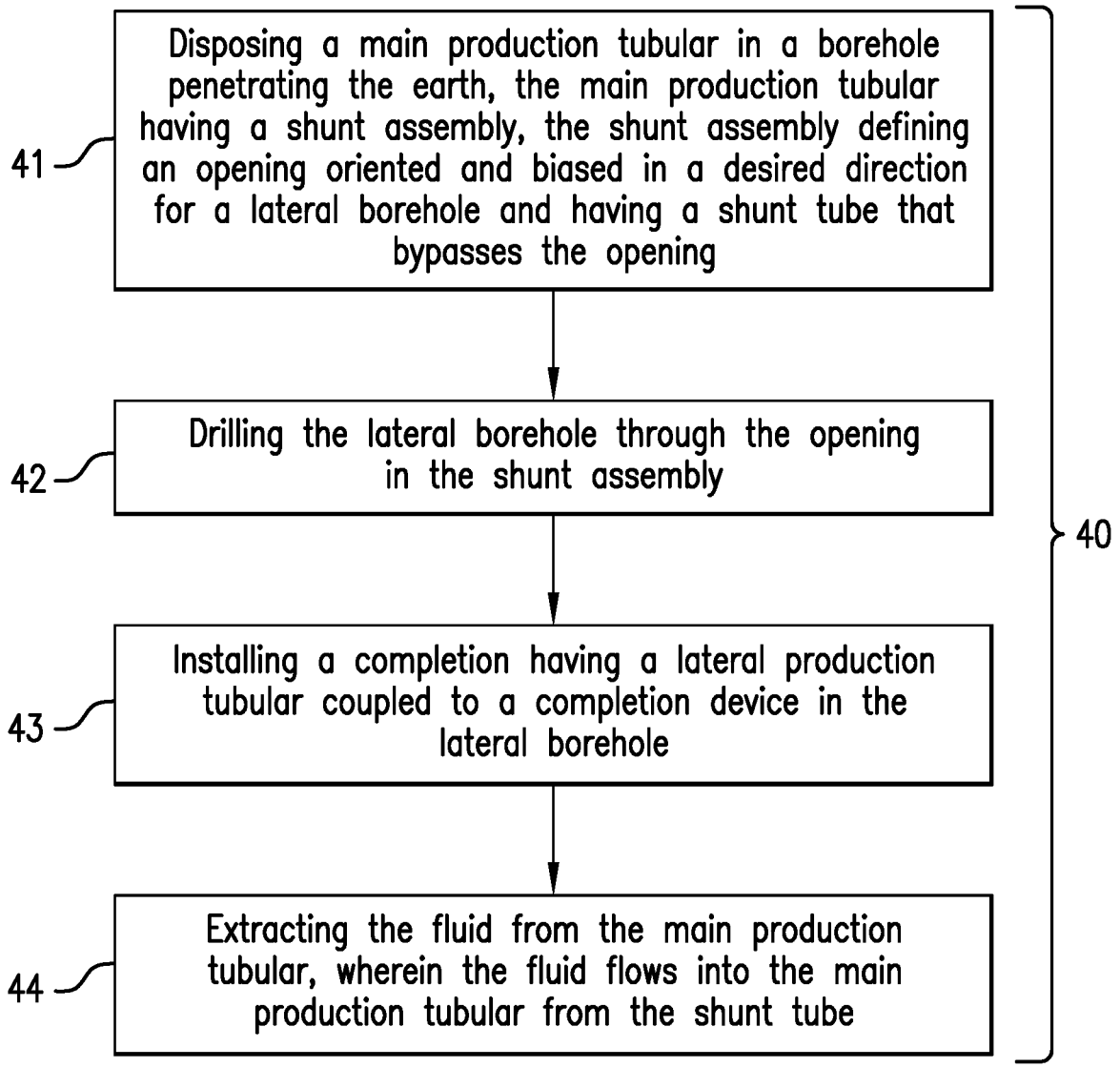
FIG. 4 is a flow chart for a method for installing a completion in the lateral borehole.

FIG. 4 is a flow chart for a method 40 for flowing a fluid from and/or to a subsurface formation. Block 41 calls for disposing a main production tubular in a borehole penetrating the earth, the main production tubular having a shunt assembly, the shunt assembly defining an opening oriented and biased in a desired direction for a lateral borehole and having a shunt tube that bypasses the opening. The term "biased" relates to a centerline of the shunt assembly being offset towards the opening and thus allowing room for the shunt tube to bypass the middle section of the main production tubular within the shunt assembly and to provide unimpeded access to the borehole wall for drilling the lateral borehole. In one or more embodiments for flowing the fluid from the subsurface formation to the surface, fluid flow in the main production tubular directly below the shunt assembly is directed into the shunt tube by a lower end section of the shunt assembly. In one or more embodiments, fluid flow at an upper end of the shunt tube is directed into the main production tubular directly above the shunt assembly by an upper end section of the shunt assembly. In one or more embodiments, the shunt tube leads directly to a flow diverter above the shunt assembly that directs fluid flow into the main production tubular. In one or more embodiments having a series of shunt assemblies, the flow diverter is above the shallowest shunt assembly. In one or more embodiments for flowing the fluid to the subsurface formation, the upper end section directs flow from the main production tubular into the shunt tube and the lower end section directs flow from the shunt tube into the main production tubular below the shunt assembly.

Block 42 calls for drilling the lateral borehole through the opening in the shunt assembly. In one or more embodiments having a series of shunt assemblies, the lateral borehole is drilled in the deepest shunt assembly first. In one or more embodiments, the lateral borehole is drilled using coiled tubing. Block 42 may include installing a plug in a lower end of the shunt assembly.

Block 43 calls for installing a completion having a lateral production tubular coupled to a completion device in the lateral borehole through the opening. Block 43 may also include installing a liner top packer about a top of the lateral production tubular within the shunt assembly to seal the lateral production tubular to a section of the main production tubular within the shunt assembly. The completion device may be configured for filtering sand and debris from formation fluids such as hydrocarbons being extracted. Alternatively, the completion may be configured for injecting a fluid into the formation through devices that may limit and distribute the injected fluid evenly forcing the completion to have mechanical isolation to the sand interface.

Block 44 calls for flowing the fluid from the subsurface formation to the shunt tube and/or from the shunt tube to the subsurface formation. The fluid can flow into the main production tubular for extraction at the surface from the formation below the deepest shunt assembly and/or from one or more laterals. Fluid from the surface of the earth can flow to the formation below the deepest shunt assembly and/or to one or more laterals through the shunt tube.

The method 40 may also include installing a packer about the main production tubular between the shunt assemblies.

The method 40 may also include preventing sand from entering the lateral production tubular using a sand screen.

The method 40 may also include injecting a fluid into the subsurface formation using an injector coupled to the lateral production tubular.

The disclosure herein provides several advantages. One advantage is that it is possible to have multilateral coiled tubing drilled completions with all laterals having true sand control completions. This is accomplished by diverting flow from a lower lateral past the next lateral junction by way of the shunt tube and that flow can be shut off by a sliding sleeve or pressure relief device and the next laterals completion is isolated below the selective flow device. In other words, the advantage is to divert flow until the next completion is sealed. It allows the lowest completion to be landed prior to any of the following laterals to be drilled. It diverts controlled flow from the lower laterals around the lateral being drilled until that lateral has the appropriate completion installed. Another advantage is to have the biased towards the azimuthal direction of the lateral borehole to be drilled to support dual string exits or completions specifically set up for laterals performed at a later date. Yet another advantage is to provide a bore for a liner top packer to be set on top of the lateral liner or lateral production tubular. Yet another advantage is the disclosed method may also apply to rotary drilling with a drill string when sealed junctions were needed without access to the laterals. Yet another advantage is it allows for multilateral completions to be performed when sand control or zonal isolation is needed in a cost effective way.

Set forth below are some embodiments of the foregoing disclosure:

Embodiment 1: A method for flowing a fluid from and/or to a subsurface formation, the method including disposing a main production tubular in a main borehole penetrating the subsurface formation, the main production tubular being coupled to a shunt assembly, the shunt assembly defining an opening oriented and biased in a desired direction for a lateral borehole penetrating the subsurface formation and having a shunt tube that bypasses the opening, drilling the lateral borehole through the opening in the shunt assembly, installing a completion having a lateral production tubular coupled to a completion device in the lateral borehole through the opening, and flowing the fluid from the subsurface formation to the shunt tube and/or from the shunt tube to the subsurface formation.

Embodiment 2: The method according to any prior embodiment, wherein the shunt assembly includes a series of shunt assemblies at selected locations along the main production tubular.

Embodiment 3: The method according to any prior embodiment, further including flowing the fluid in the shunt tube in a direction substantially parallel to the main borehole along the series of shunt assemblies and flowing the fluid into the main production tubular above a shallowest shunt assembly using a diverter coupled to the shunt tube and the main production tubular.

Embodiment 4: The method according to any prior embodiment, further including flowing the fluid in the main production tubular directly below and directly above each shunt assembly and in the shunt tube along each shunt assembly.

Embodiment 5: The method according to any prior embodiment, further including installing a packer about the main production tubular between the shunt assemblies.

Embodiment 6: The method according to any prior embodiment, further including installing a plug in a lower section of the shunt assembly prior to the drilling.

Embodiment 7: The method according to any prior embodiment, further including installing a liner top packer about a top of the lateral production tubular within the shunt assembly to seal the lateral production tubular to a section of the main production tubular within the shunt assembly.

Embodiment 8: The method according to any prior embodiment, wherein flowing the fluid from the subsurface formation to the shunt tube includes flowing the fluid through a sand control completion prior to the shunt tube to prevent sand from entering the lateral production tubular.

Embodiment 9: The method according to any prior embodiment, further including injecting a fluid into the subsurface formation using an injector coupled to the lateral production tubular.

Embodiment 10: The method according to any prior embodiment, wherein the fluid includes hydrocarbons that are extracted from the subsurface formation and flowed to the surface using the shunt tube.

Embodiment 11: An apparatus for flowing a fluid from and/or to a subsurface formation, the apparatus including a main production tubular disposed in a borehole penetrating the subsurface formation, a shunt assembly coupled to the main production tubular, the shunt assembly defining an opening oriented and biased in a desired direction for a lateral borehole penetrating the subsurface formation and having a shunt tube that bypasses the opening and conveys the fluid from and/or to the subsurface formation, a lateral production tubular disposed in the lateral borehole and coupled to the main production tubular through the shunt assembly, and a completion device coupled to the lateral production tubular.

Embodiment 12: The apparatus according to any prior embodiment, wherein the shunt tube includes a plurality of shunt tubes offset from a centerline of the borehole.

Embodiment 13: The apparatus according to any prior embodiment, wherein the shunt assembly includes an upper end section and a lower end section with the lower end section being in fluid communication with the shunt tube and a lower section of the main production tubular.

Embodiment 14: The apparatus according to any prior embodiment, further including a diverter connecting the shunt tube to the main production tubular above a shallowest shunt assembly.

Embodiment 15: The apparatus according to any prior embodiment, wherein the shunt assembly includes an upper end section and a lower end section with the upper end section being in fluid communication with the shunt tube and an upper section of the production tubular and the lower end section being in fluid communication with the shunt tube and a lower section of the main production tubular.

Embodiment 16: The apparatus according to any prior embodiment, further including a plug disposed within a lower section of the shunt assembly.

Embodiment 17: The apparatus according to any prior embodiment, further including a liner top packer disposed about a top of the lateral production tubular within the shunt assembly to seal the lateral production tubular to a section of the main production tubular within the shunt assembly.

Embodiment 18: The apparatus according to any prior embodiment, further including a packer disposed about the main production tubular to secure the main production tubular to the borehole.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for flowing a fluid from and/or to a subsurface formation, the method comprising:

disposing a main production tubular having a single flow path in a main borehole penetrating the subsurface formation, the main production tubular being coupled to a shunt assembly at a first end of the shunt assembly leading to the surface and a second end of the shunt assembly leading deeper into the borehole, the shunt assembly defining an opening oriented and biased in a desired direction for a lateral borehole penetrating the subsurface formation and having a shunt tube that bypasses the opening, the shunt tube being in fluid communication with the main production tubular at at least one of the first end or second end of the shunt assembly;

drilling the lateral borehole through the opening in the shunt assembly;

installing a completion having a lateral production tubular coupled to a completion device in the lateral borehole through the opening wherein the lateral production tubular is in fluid communication with the main production tubular at the first end; and flowing the fluid from the subsurface formation to the shunt tube and/or from the shunt tube to the subsurface formation.

2. The method according to claim 1, wherein the shunt assembly comprises a series of shunt assemblies at selected locations along the main production tubular.

3. The method according to claim 2, further comprising flowing the fluid in the shunt tube in a direction substantially parallel to the main borehole along the series of shunt assemblies and flowing the fluid into the main production tubular above a shallowest shunt assembly using a diverter coupled to the shunt tube and the main production tubular.

4. The method according to claim 2, further comprising flowing the fluid in the main production tubular directly below and directly above each shunt assembly and in the shunt tube along each shunt assembly.

5. The method according to claim 4, further comprising installing a packer about the main production tubular between the shunt assemblies.

6. The method according to claim 1, further comprising installing a plug in a lower section of the shunt assembly prior to the drilling.

7. The method according to claim 1, further comprising installing a liner top packer about a top of the lateral production tubular within the shunt assembly to seal the lateral production tubular to a section of the main production tubular within the shunt assembly.

8. The method according to claim 1, wherein flowing the fluid from the subsurface formation to the shunt tube comprises flowing the fluid through a sand control completion prior to the shunt tube to prevent sand from entering the lateral production tubular.

9. The method according to claim 1, further comprising injecting a fluid into the subsurface formation using an injector coupled to the lateral production tubular.

10. The method according to claim 1, wherein the fluid comprises hydrocarbons that are extracted from the subsurface formation and flowed to the surface using the shunt tube.

11. The method according to claim 1, wherein the shunt tube is in fluid communication with the main production tubular at the first end and at the second end of the shunt assembly.

12. An apparatus for flowing a fluid from and/or to a subsurface formation, the apparatus comprising:

a main production tubular having a single flow path disposed in a borehole penetrating the subsurface formation;

a shunt assembly coupled to the main production tubular at a first end of the shunt assembly leading to the surface and a second end of the shunt assembly leading deeper into the borehole, the shunt assembly defining an opening oriented and biased in a desired direction for a lateral borehole penetrating the subsurface formation and having a shunt tube that bypasses the opening and conveys the fluid from and/or to the subsurface formation, the shunt tube being in fluid communication with the main production tubular at at least one of the first end or second end of the shunt assembly;

a lateral production tubular disposed in the lateral borehole and coupled to the main production tubular through the shunt assembly such that the lateral production tubular is in fluid communication with the main production tubular at the first end; and a completion device coupled to the lateral production tubular.

13. The apparatus according to claim 12, wherein the shunt tube comprises a plurality of shunt tubes offset from a centerline of the borehole.

14. The apparatus according to claim 12, wherein the shunt assembly comprises an upper end section and a lower end section with the lower end section being in fluid communication with the shunt tube and a lower section of the main production tubular.

15. The apparatus according to claim 14, further comprising a diverter connecting the shunt tube to the main production tubular above a shallowest shunt assembly.

16. The apparatus according to claim 12, wherein the shunt assembly comprises an upper end section and a lower end section with the upper end section being in fluid communication with the shunt tube and an upper section of the production tubular and the lower end section being in fluid communication with the shunt tube and a lower section of the main production tubular.

17. The apparatus according to claim 12, further comprising a plug disposed within a lower section of the shunt assembly.

18. The apparatus according to claim 12, further comprising a liner top packer disposed about a top of the lateral production tubular within the shunt assembly to seal the lateral production tubular to a section of the main production tubular within the shunt assembly.

19. The apparatus according to claim 12, further comprising a packer disposed about the main production tubular to secure the main production tubular to the borehole.

20. The apparatus according to claim 12, wherein the shunt tube is in fluid communication with the main production tubular at the first end and at the second end of the shunt assembly.

* * * * *